US006750741B2

(12) United States Patent
Mordkovich

(10) Patent No.: US 6,750,741 B2
(45) Date of Patent: Jun. 15, 2004

(54) BAND PASS FILTER

(75) Inventor: Mikhail Mordkovich, Brooklyn, NY (US)

(73) Assignee: Scientific Components, Brooklyn, NY (US)

( * ) Notice: Subject to any disclaimer, the term of this patent is extended or adjusted under 35 U.S.C. 154(b) by 24 days.

(21) Appl. No.: 10/233,964

(22) Filed: Sep. 4, 2002

(65) Prior Publication Data

US 2003/0222737 A1 Dec. 4, 2003

Related U.S. Application Data

(60) Provisional application No. 60/385,143, filed on Jun. 4, 2002.

(51) Int. Cl.[7] ..... H01P 1/20; H01P 3/08; H01P 5/12

(52) U.S. Cl. ..... 333/204; 333/134

(58) Field of Search ..... 333/204, 110, 333/202, 134, 219, 185; 343/770; 505/210

(56) References Cited

U.S. PATENT DOCUMENTS

| | | | | | |
|---|---|---|---|---|---|
| 3,745,489 | A | * | 7/1973 | Cristal et al. | 333/185 |
| 4,264,881 | A | * | 4/1981 | De Ronde | 333/110 |
| 6,043,786 | A | * | 3/2000 | Vannatta et al. | 343/770 |
| 6,130,189 | A | * | 10/2000 | Matthaei | 505/210 |
| 6,608,538 | B2 | * | 8/2003 | Wang | 333/204 |

* cited by examiner

*Primary Examiner*—Patrick Wamsley
(74) *Attorney, Agent, or Firm*—Kevin Redmond

(57) ABSTRACT

A band pass hairpin filter that has improved pass band performance and low loss. The filter has a dielectric substrate. The dielectric substrate has a top and bottom surface. A hairpin resonator is mounted to the top surface. The resonator has an open end and a closed end. An input coupling element is located adjacent to and is communicated with the resonator. An output coupling element is located adjacent to and is communicated with the resonator. A first inductive element is connected to the resonator. A second inductive element is connected to the input coupling element. A third inductive element is connected to the output coupling element.

23 Claims, 5 Drawing Sheets

BAND PASS FILTER

This application claims the benefit of Provisional application No. 60/385,143 filed Jun. 4, 2002.

BACKGROUND

1. Field of the Invention

This invention relates to filters in general and more particularly to microwave hairpin filters that have improved low frequency stop band and pass band performance.

2. Description of Related Art

Many different types of filters are known for the processing of electrical signals. For example, in communications applications, such as for microwave frequencies, it is desirable to filter out small individual pass bands. This allows a fixed frequency spectrum to be divided into a large number of bands. In order to select certain bandwidth frequencies, the bandwidth must be reduced by rejecting unwanted frequencies above and below the desired bandwidth. The objective of a filter is to have a minimum loss of the frequencies in the desired bandwidth, (called the pass band), with significant losses of the unwanted frequencies below and above the desired pass band of frequencies. The unwanted low frequency bandwidths are referred to as low frequency stop band. The unwanted high frequency bandwidths are referred to as high frequency stop band.

In certain applications, greater rejection of the low and high frequency stop bands are necessary than a single resonator filter can achieve. For greater rejection, additional resonators must be added to the filter. Typically, the greater the number of resonators, the greater the rejection of unwanted high and low frequencies. However, adding additional resonators also increases insertion loss in the pass band and also increases the physical size of the filter. The additional resonators add complexity and take up more space on a printed circuit board.

A well known prior art filter is shown in FIG. 1. FIG. 1 is a hairpin micro-strip filter. Filter 20 has a substrate 32 with a top surface 32A and bottom surface 32B. An input coupling element 34, a U shaped resonator 50 and an output coupling element 40 are located on top surface 32A. Input coupling element 34 has an input pad 35 and coupling line 36. U shaped resonator 50 has a closed end 52 and an open end 54 Output coupling element 40 has a pad 41 and coupling line 42. A gap 56 is located between input coupling element 34 and resonator 50. A gap 58 is located between output coupling element 40 and resonator 50. The substrate can be ceramic or a soft printed circuit board. The resonator and coupling elements would typically be etched copper printed circuit lines. The input coupling element, output coupling element and resonator are electromagnetically coupled as is known in the art.

The filter of FIG. 1 reduces the amount of space needed for multiple resonators. As each resonator is added, the hairpin configuration condenses the physical size by utilizing side by side coupling.

Referring to FIG. 2, a three resonator prior art filter 25 having three hairpin resonators mounted side by side is shown. Filter 25 is similar to filter 20 except that three resonators 50 are mounted side by side between the input and output coupling elements. Gaps 60 separate the resonators.

Certain applications place a greater requirement on rejecting the low frequency stop band relative to the high frequency stop band. For example, in filtering a signal after utilizing frequency doublers or frequency multipliers. The prior art hairpin filters do not provide adequate subharmonic suppression with a given quantity of resonators. Further, the prior art filters require multiple resonators which take up excessive printed circuit boards space.

While various band pass filters have previously been used, they have suffered from not having enough rejection in the low stop band, excessive loss in the pass band, being expensive to produce and requiring excessive circuit board space.

A current unmet need exists for an improved filter that is compact, has greater suppression, improved low frequency stop band performance, minimum loss in the pass band and is readily manufactured at low cost.

SUMMARY

It is a feature of the invention to provide a hairpin filter that has improved low frequency stop band performance and improved pass band performance.

Another feature of the invention is to provide a hairpin filter that is more manufacturable at lower cost.

Another feature of the invention to provide a filter that includes a dielectric substrate. The dielectric substrate has a top and bottom surface. A hairpin resonator is mounted to the top surface. The resonator has an open end and a closed end. An input coupling element is located adjacent to and is communicated with the resonator. An output coupling element is located adjacent to and is communicated with the resonator. A first inductive element is connected to the resonator. A second inductive element is connected to the input coupling element. A third inductive element is connected to the output coupling element.

BRIEF DESCRIPTION OF THE DRAWINGS

It is noted that the drawings of the invention are not to scale. In the drawings, like numbering represents like elements between the drawings.

DETAILED DESCRIPTION

Figure 3:
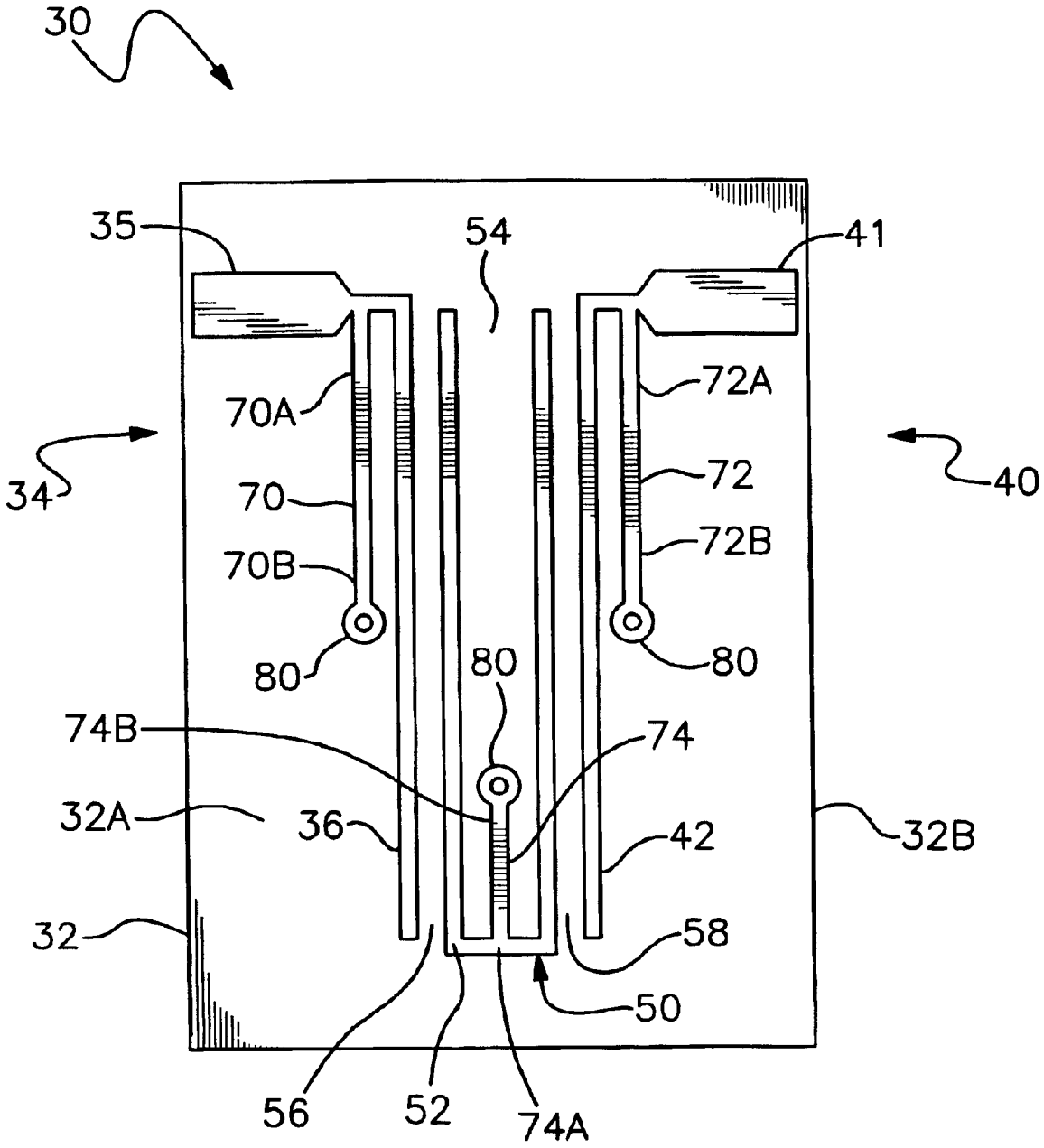
FIG. 3 is a top view of the preferred embodiment of a filter according to the present invention.

Referring to FIG. 3, a top view of the preferred embodiment of a filter according to the present invention is shown. Filter 30 has a substrate 32 with a top surface 32A and bottom surface 32B. Substrate 32 is formed of an insulative dielectric material such as a printed circuit board. Substrate 32 could also be formed from a ceramic substrate or other suitable material. An input coupling element 34, a U shaped resonator 50 and an output coupling element 40 are located on top surface 32A. The coupling elements and resonator are conductors such as etched printed circuit lines The coupling elements and resonator could also be a screen printed thick film material or other suitable conductors.

Input coupling element 34 has an input pad 35 and coupling line 36. Similarly, output coupling element 40 has a pad 41 and coupling line 42.

A U-shaped resonator 50 is located between input and output coupling elements 34 and 40. Resonator 50 has resonator lines 50A, 50B, a closed end 52 and an open end 54. A gap 56 is located between input coupling element 34 and resonator 50. A gap 58 is located between output coupling element 40 and resonator 50. Coupling lines 36 and 42 run parallel with the lines of resonator 50. Coupling line 36 is electro-magnetically coupled to resonator 50 across gap 56. Coupling line 42 is electro-magnetically coupled to resonator 50 across gap 58.

Three inductive shunt elements 70, 72 and 74 are attached to filter 30 Inductive shunt element 70 has ends 70A and 70B. End 70A is connected to the junction of input coupling line 36 and pad 35. End 70B is grounded through a plated through hole 80 that is attached to end 70B. Inductive element 70 is a circuit line that extends from end 70A, where it is attached, parallel to line 36 toward closed end 52. Inductive shunt element 72 has ends 72A and 72B. End 72A is connected to the junction of output coupling line 42 and pad 41. End 72B is attached to grounded plated through hole 80. Inductive element 72 is a circuit line that extends from end 72A, where it is attached, parallel to line 42 toward closed end 52.

Inductive shunt element 74 has ends 74A and 74B. End 74A is connected to resonator 50. End 74B is grounded through plated through hole 80. Inductive element 74 is a circuit line that extends from end 74A, where it is attached, parallel to resonator 50 toward open end 54. Inductive element 74 is located between the resonator lines 50A and 50B.

It is noted that several band pass filters 30 could be coupled together either on the same substrate or on separate substrates if desired.

Figure 4:
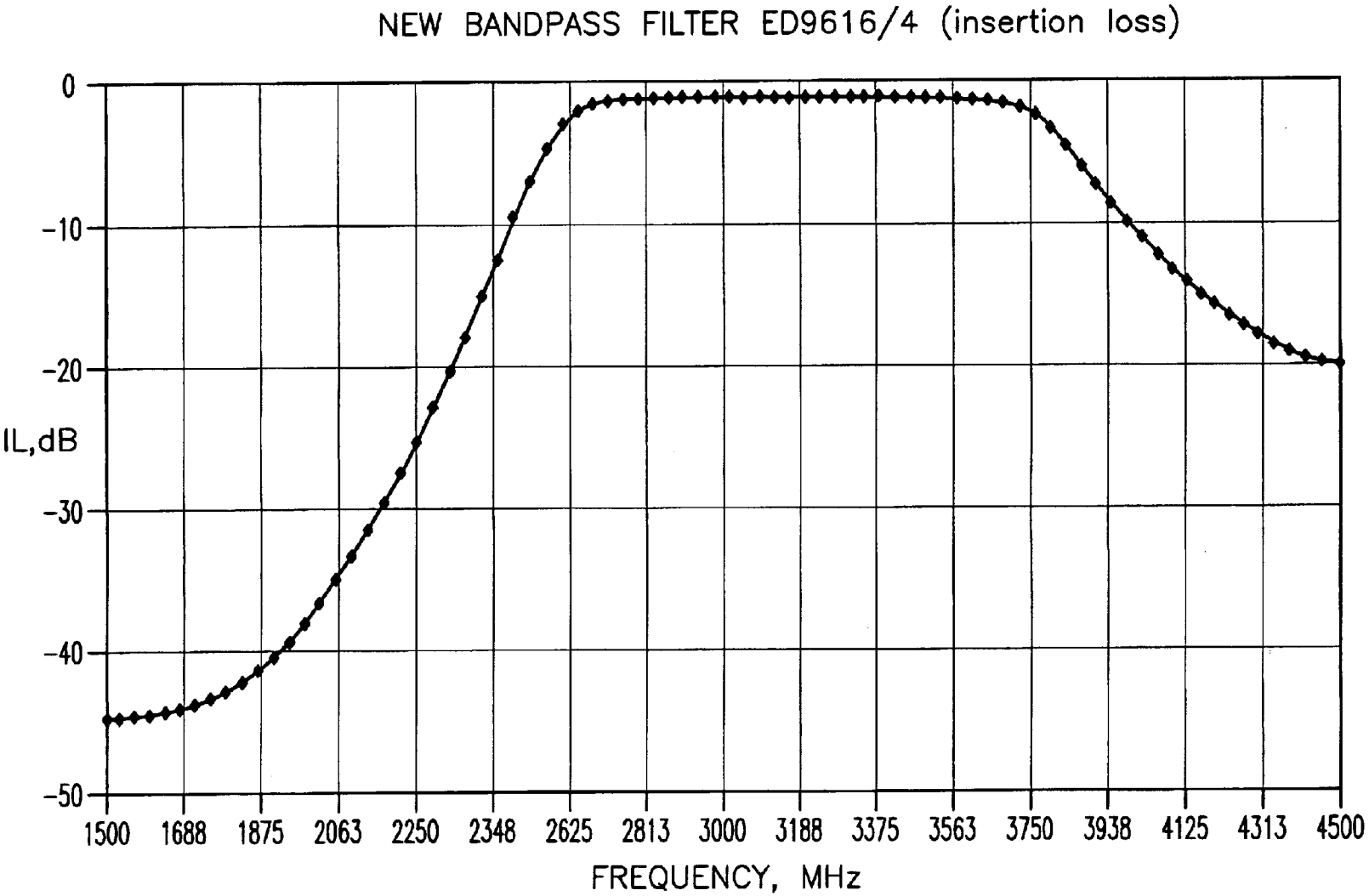
FIG. 4 is a graph of insertion loss versus frequency for the filter of FIG. 3.
Figure 5:
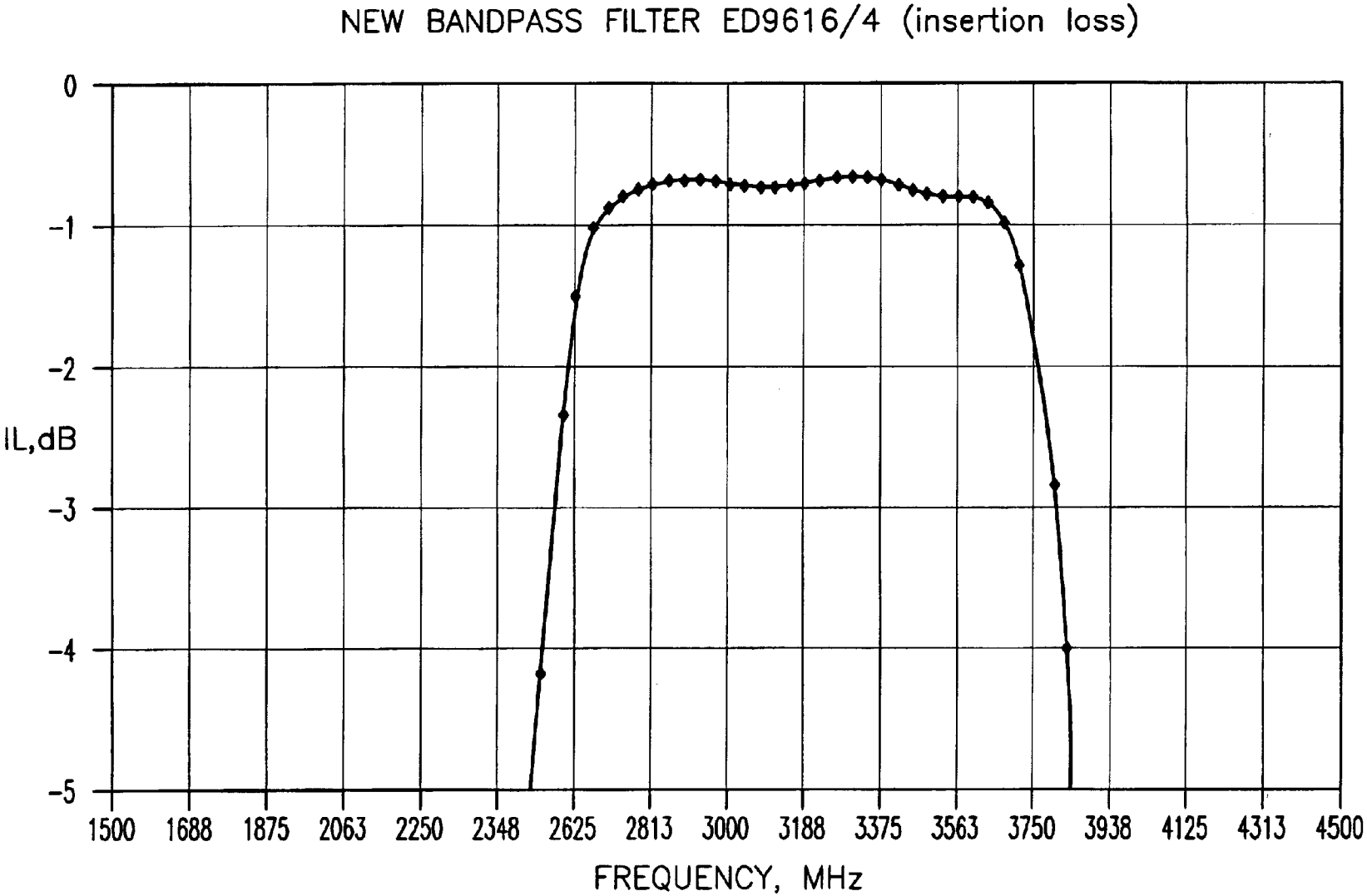
FIG. 5 is an enlarged view of FIG. 4 showing details of the insertion loss in the pass band.
Figure 6:
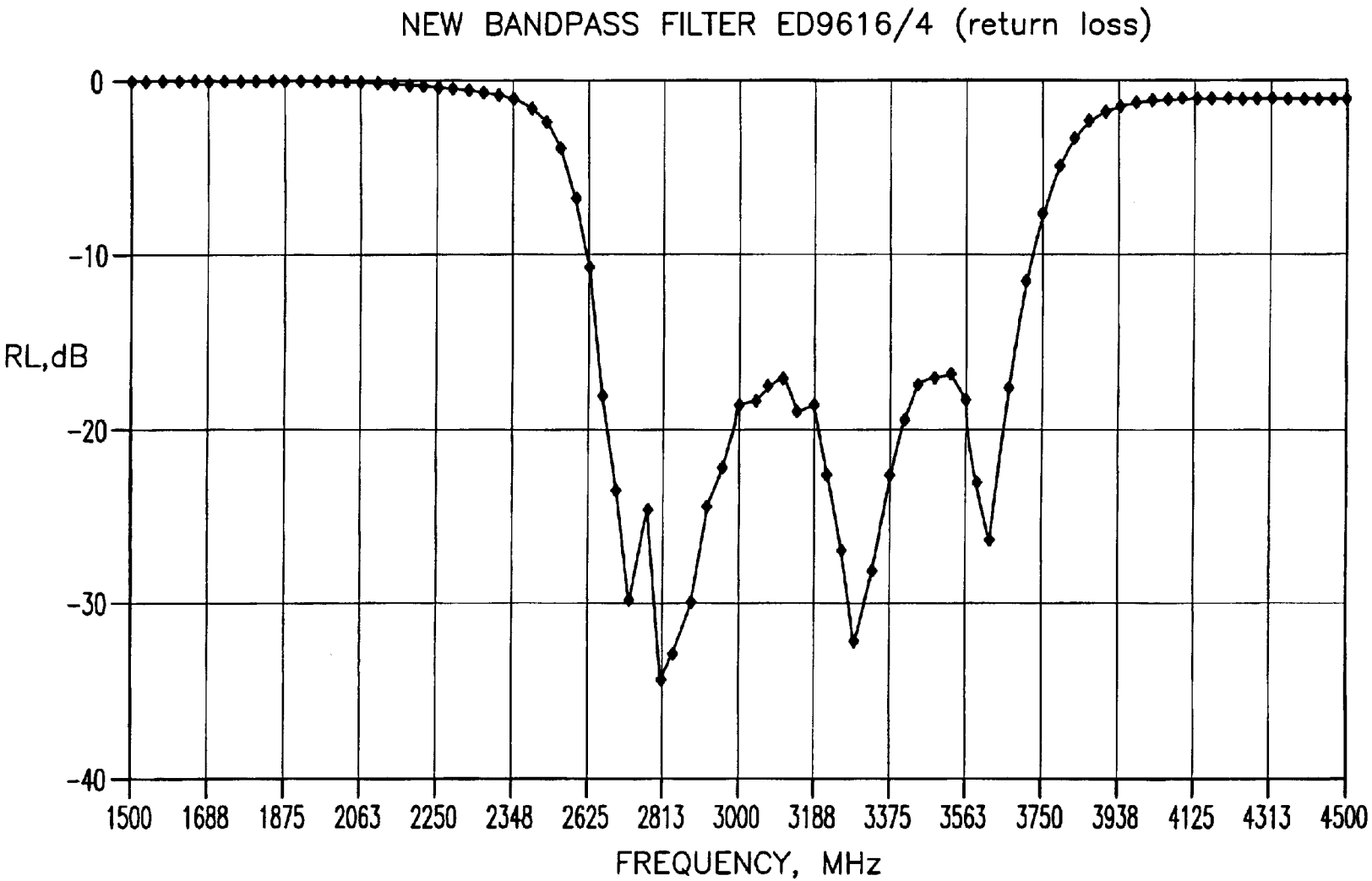
FIG. 6 is a graph of return loss versus frequency for the filter of FIG. 3.

Several Band pass filters 30 were fabricated and tested for electrical performance. The results are shown graphically in the following figures. FIG. 4 shows a graph of insertion loss versus frequency for filter 30. FIG. 5 is an enlarged it view of FIG. 4 showing details of the insertion loss between 0 and −5 db in the pass band. FIG. 6 shows a graph of return loss versus frequency for filter 30. The inductive elements 70, 72 and 74 provide band pass filter 30 with improved rejection and less insertion loss.

Figure 1:
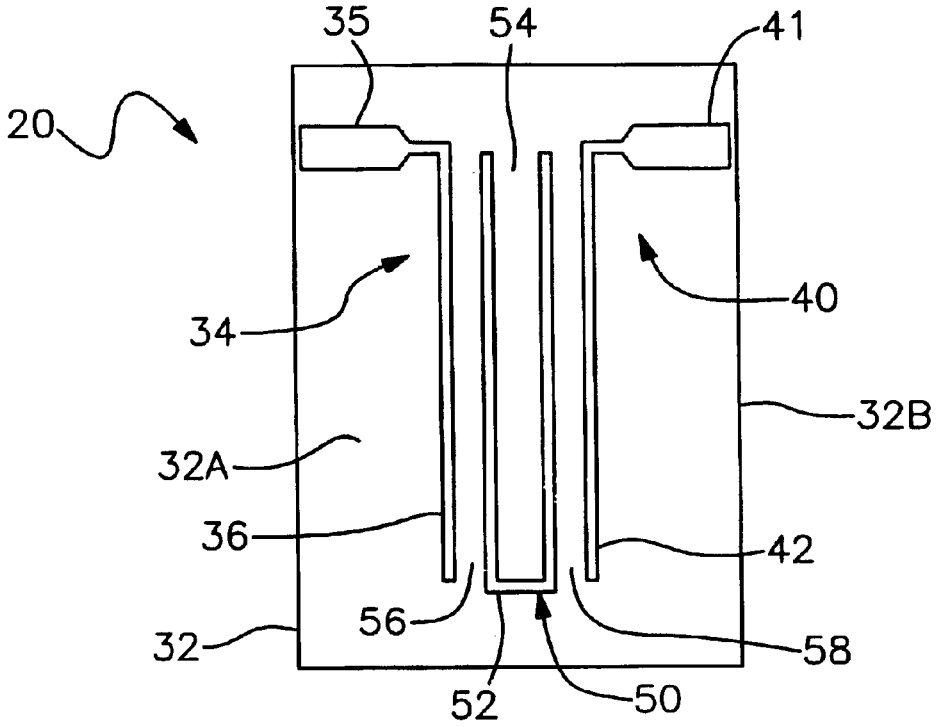
Fig. 1 (Prior Art)
FIG. 1 is a top view of a prior art filter.
Figure 2:
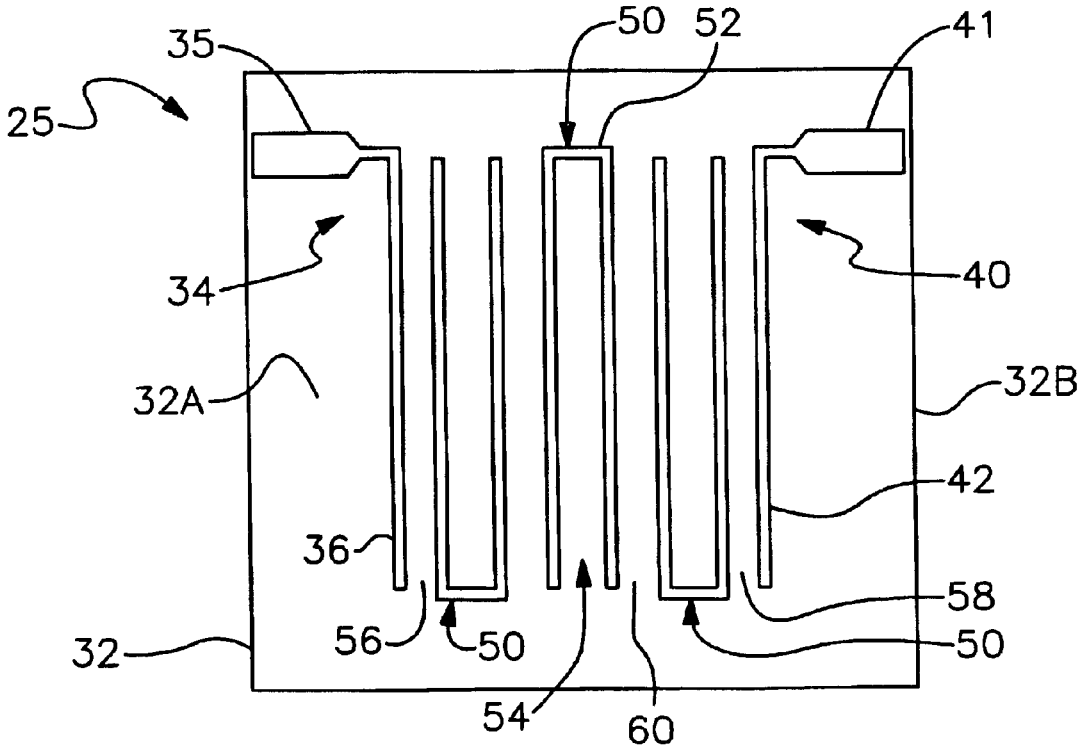
Fig. 2 (Prior Art)
FIG. 2 is a top view of another prior art filter.

The present invention has several advantages. The inductive elements 70, 72 and 74 provide additional rejection of unwanted low frequency stop band while reducing the overall size of the filter resulting in a smaller package. The filter of the present invention has improved sub-harmonic suppression relative to the filters of FIGS. 1 and 2 with less loss in the pass band than the filter of FIG. 2. The insertion loss of filter 30 in the pass band is comparable to a single resonator filter. The filter of the present invention provides 20 dB better rejection in the low frequency stop band than a three resonator hairpin filter. The short inductive elements occupy a small space allowing better performance than a three resonator filter to be packaged in the about the space of a single resonator filter. The invention provides a savings of space on the printed circuit board and lowers cost.

Another advantage to the present invention is increased manufacturability due to the size of the coupling lines, gaps and resonator. In a prior art 3 resonator hairpin having 30% band pass, the gaps between lines are on the order of 6 mils (thousandths of an inch). In the present invention, the gaps can be 15 to 20 mils in dimension. The larger gap also provides less sensitivity to manufacturing tolerances allowing a greater variation in the dimension of the finished filter while still meeting the required electrical performance requirements.

Band pass filter 30 has improved sub-harmonic suppression with greater rejection in the low frequency stop band, lower insertion loss in the pass band and has better manufacturability providing an improvement over previous filters.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What is claimed is:

1. A filter comprising:

a) a dielectric substrate;

b) at least one side coupled resonator mounted to the substrate, the resonator having an open end and a closed end;

c) an input coupling element located adjacent to one side of the resonator;

d) an output coupling element located adjacent to another side of the resonator; and e) a circuit line connected to the closed end of the side coupled resonator and extending toward the open end of the side coupled resonator, the circuit line having an inductance that provides the filter with improved rejection and less insertion loss.

2. The filter according to claim 1, wherein a first inductive element is attached to the input coupling element.

3. The filter according to claim 2, wherein a second inductive element is attached to the output coupling element.

4. The filter according to claim 3, wherein the second inductive element has a fifth end and a sixth end, the fifth end attached to the output coupling element and the sixth end extending toward the closed end of the side coupled resonator.

5. The filter according to claim 4, wherein the sixth end is connected to ground.

6. The filter according to claim 2, wherein the first inductive element has a third end and a fourth end, the third end attached to the input coupling element and the fourth end extending toward the closed end of the side coupled resonator.

7. The filter according to claim 6, wherein the fourth end is connected to ground.

8. The filter according to claim 1, wherein the circuit line has a first end and a second end, the second end of the circuit line connected to the closed end of the side coupled resonator.

9. The filter according to claim 8, wherein the first end of the circuit line is connected to ground.

10. A filter having low insertion loss and high rejection outside a pass band comprising:

a) a dielectric substrate having a first and second surface;

b) at least one hairpin resonator mounted to the top surface, the hairpin resonator having an open end and a closed end;

c) an input coupling element located adjacent to the resonator, the input coupling element having an input pad and an fir input coupling line;

d) an output coupling element located adjacent to the resonator, the output coupling element having an output pad and an output coupling line; and e) a first circuit line connected to the closed end of the hairpin resonator and extending toward the open end of the hairpin resonator.

11. The filter according to claim 10, wherein the input and output coupling lines are spaced from the resonator by a gap.

12. The filter according to claim 11, wherein the gap is 15 to 20 thousandths of an inch in width.

13. The filter according to claim 10, wherein a second circuit line is connected to the input coupling line.

14. The filter according to claim 10, wherein a third circuit line is connected to the output coupling line.

15. The filter according to claim 10, wherein an end of the first circuit line is connected to ground.

16. A filter comprising:

a) a dielectric substrate having a first and second surface;

b) at least one u-shaped resonator mounted to the first surface, the resonator having an open end and a closed end;

c) an input coupling element located adjacent to and communicated with the resonator;

d) an output coupling element located adjacent to and communicated with the resonator;

e) a first inductive element connected to the closed end of the resonator;

f) a second inductive element connected to the input coupling element; and g) a third inductive element is connected to the output coupling element.

17. The filter according to claim 16, wherein the inductive elements are a circuit lines having a first en and a second ends.

18. The filter according to claim 16, wherein the first inductive element extends toward the open end.

19. The filter according to claim 16, wherein the second and third inductive elements extend toward the closed end.

20. The filter according to claim 16, wherein the coupling elements each have a pad and a line, the line spaced from the resonator by a gap.

21. The filter according to claim 16, wherein a plurality of the filters are connected.

22. The filter according to claim 16, wherein the resonator has a first and second resonator line, the first and second resonator lines being substantially parallel, the closed end connected between the first and second resonator lines.

23. The filter according to claim 16, wherein the first inductive element extends parallel with the u-shaped resonator.

* * * * *